US008838344B2

(12) United States Patent
Callan et al.

(10) Patent No.: US 8,838,344 B2
(45) **Date of Patent: *Sep. 16, 2014**

(54) APPARATUS FOR HIGH CAPACITY STONE DELIVERY WITH CONCENTRIC FLOW AND ENHANCED NOSECONE FOR SOIL IMPROVEMENT

(76) Inventors: Sean G. Callan, Santa Monica, CA (US); Juan I. Baez, Santa Monica, CA (US)

( * ) Notice: Subject to any disclaimer, the term of this patent is extended or adjusted under 35 U.S.C. 154(b) by 684 days.

This patent is subject to a terminal disclaimer.

(21) Appl. No.: 13/019,392

(22) Filed: Feb. 2, 2011

(65) Prior Publication Data

US 2012/0039671 A1 Feb. 16, 2012

Related U.S. Application Data

(60) Provisional application No. 61/372,290, filed on Aug. 10, 2010.

(51) Int. Cl.

| | |
|---|---|
| ***G06F 7/70*** | (2006.01) |
| ***G06F 19/00*** | (2011.01) |
| ***G06G 7/00*** | (2006.01) |

(52) U.S. Cl.
USPC ..... 701/50

(58) Field of Classification Search
CPC ..... E02F 9/2025; E02F 9/26; A01B 79/005; E02D 3/08
USPC ..... 701/50
See application file for complete search history.

(56) References Cited

U.S. PATENT DOCUMENTS

2006/0088388 A1* 4/2006 Wissmann et al. ..... 405/232
2007/0011994 A1* 1/2007 Wooldridge ..... 53/473

* cited by examiner

*Primary Examiner* — Maceeh Anwari
(74) *Attorney, Agent, or Firm* — Grant's Law Firm; Allan Grant

(57) ABSTRACT

An apparatus for forming a column of compacted material in soil to increase load bearing capabilities and to provide drainage through a system having: a hopper, a stone chamber, a transition splitter pipe having at least two outlet chutes, a vibratory probe mechanism having a tip, a nosecone, and a control system; the vibratory probe mechanism has same number of chutes as the transition splitter pipe; the additional chutes are positioned along the side of the vibratory probe mechanism to increasing the flow rate of a material being discharged into a soil; the hopper is connected to the stone chamber which in turn is connected to the transition splitter pipe, the transition splitter pipe has chutes that are connected to the chutes of the vibratory probe mechanism, wherein the vibratory probe mechanism is connected to the nosecone; the control system constantly monitors the pressure of the air in the system to ensure that the chutes continuously and uniformly discharge the material; wherein the control system has one or more valves, and one or more sensors, which are interlocked together to create a pressurized air system which is necessary in order to assist the material to travel down the pipes and into the chutes and out at the tip of the vibratory probe mechanism.

32 Claims, 10 Drawing Sheets

APPARATUS FOR HIGH CAPACITY STONE DELIVERY WITH CONCENTRIC FLOW AND ENHANCED NOSECONE FOR SOIL IMPROVEMENT

CROSS-REFERENCE TO RELATED APPLICATIONS

The present application claims priority under 35 U.S.C. 119(e) and under all applicable U.S. statutes and regulations, to U.S. Provisional Application Ser. No. 61/372,290, filed Aug. 10, 2010. The disclosure of which is hereby incorporated herein by reference in its entirety.

FIELD OF THE INVENTION

The present invention relates to a method and apparatus for constructing stone columns to improve soil stability that is more economical and with a higher quality than has been achieved with previous equipment by increasing production rates, reducing cost, and improving quality. More particularly, the present invention is directed to methods and apparatus for a high capacity stone column bottom feeding apparatus having multiple chutes for increased stone delivery that includes a control system, which can be hand operated or fully automated electronically for controlling the flow of air and pressure of air in the system during the ground improvement process as well as display the results on a screen in the operator's cab in real time.

BACKGROUND OF THE INVENTION

Stone columns are simply vertical columns of compacted crushed stone, gravel or sand which extend through a deposit of soft material or soil to be strengthened. In general, a number of these densely compacted granular material columns are produced beneath the site for the intended construction project. These columns serve to stabilize the soil, resulting in considerable vertical load capacity and improved shear resistance in the soil mass. The stone columns improve drainage in fine grained soil deposits and increase load bearing capacity to a point where considerably larger bearing stresses may be sustained without causing detrimental or excessive settlement or bearing capacity failure in the ground.

The following applications have used stone columns for soil stabilization to limit loose dirt settlement under reinforced earth walls, tank farms, dam and highway embankments, bridge abutments, and buildings. Another application is the stabilization and prevention of landslides. Stone columns also function as efficient gravel drains in providing a path for relief of excess pore water pressures, thus preventing liquefaction during an earthquake.

Although there are a number of well-known methods for the formation of stone columns in the ground. A common method is the use of a special vibrator, sometimes known as a Vibroflot, which expels water from its body as it sinks into the ground, thus forming a hole which is held open by water pressure and then filled with stone and the stone is compacted into the ground in stages using the vibrator. An example of this method is described in U.S. Pat. No. 4,397,588 for method of constructing a compacted granular or stone column in soil masses and apparatus. This method is more commonly know as the Wet Top Feed Method.

Utilization of this method produces very large quantities of soil laden water by-product which must be disposed of. Disposal of this by-product is difficult and expensive under the best of conditions, and virtually prohibitive at environmentally sensitive locations. Consequently, most column installations with vibrators now make use of ancillary bottom-feed equipment which provides a feed pipe to the tip of the vibrator. Stone is fed through this pipe to the tip of the vibrator using compressed air, thus eliminating the need for water. Although production by this method is somewhat slower, and thus slightly more expensive, savings in the disposal of the by-product usually more than offsets the additional cost. This method is more commonly know as the Dry Bottom Feed Method Dry Bottom Feed stone columns are a soil improvement technique for such applications where the Wet Top Feed Method is not feasible due to problems related to the by product of flushing water that is produced with the Wet Top Feed Method Both the Wet Top Feed technique and the Dry Bottom Feed technique are both suitable for installing stone columns which can be used to reduce the effects of differential soil settlements and accelerates the time which cohesive soils require to consolidate.

Since soil with a fines content of less than 12% will compact easier with the vibrations associated with column installation, the stone column method (dry or wet) is ideal for the prevention of soil liquefaction in the event of an earthquake by compacting granular layers of soil. Stone columns also reinforce and drain cohesive soils at the same time.

The dry bottom feed method occurs when a stone column is installed in a way that the gravel is transported without the use of water in the special duct alongside the vibratory mechanism.

The Dry Top Feed Method is the same as the Dry Bottom Feed Method; however, in the dry top feed method the gravel is dumped into the open hole while the vibratory mechanism is fully retracted. This method works only if the hole does not collapse, i.e. instable soil above ground water table.

The wet top feed method installation occurs when the gravel is added from the top of the hole using flushing water to keep open an annular space around the vibratory mechanism.

The wet bottom feed method installation occurs when a stone column is installed in a way that the gravel is transported to the tip of the vibratory mechanism with the aid of water in the special duct alongside the vibratory mechanism.

Re-penetration occurs during the installation of stone columns, when the vibratory mechanism is lowered back into the gravel to enlarge the column diameter to the desired value.

The vibratory mechanism is typically utilized to construct a sand or stone column, wherein the probe itself generally consists of a 12 to 16 inch diameter hollow cylindrical body. In general, the vibrator is powered by a motor (electric or hydraulic) rated at a minimum of 130 kW and a minimum centrifugal force of 210 kN gyrating about a longitudinal axis to create lateral vibrations in the probe, i.e., vibrations in the horizontal plane. The minimum double amplitude (peak to peak measurement) of the probe tip is not less than 18 mm in a horizontal direction when the probe is in a free suspended position. The probe is constructed with follower tubes, electric cables, and/or hydraulic hoses. Water hoses can also be connected to the uppermost extension tube. The complete assembly of the vibrator probe (the vibratory mechanism) is usually supported from a commercial crane.

In an effort to construct a stone column utilizing this type of probe, wherein the probe is penetrated into the soil to a predetermined depth under its own weight and with vibration and assistance of a jetting fluid, the jetting fluid, which is under pressure, may be compressed air or water. At the required depth, the probe is slowly retrieved in small increments to allow backfill material to be placed under the space left by the withdrawn tip of the probe. Granular backfill material is transported to the probe tip through a transfer pipe that runs parallel to the probe down to the tip of the nosecone. The transfer pipe is fed by a hopper, typically mounted at the top of the probe assembly. As the probe is withdrawn, the granular material is fed into the void by the probe tip. As the probe is partially lowered again with the vibrating force, the freshly deposited granular material in the surrounding soil becomes compacted. By repetition of these steps, the stone column is gradually constructed.

It is universally recognized that a multi chute stone feeding system would increase production rates, reduce cost, and improve quality. But, unfortunately the industry has not been able to achieve any success in operating any twin feeding system because of constant blockages and break downs of such apparatus. As a result, the industry has move away from that system and has adopted the single pipe feed system. As such, there is a need in the art for a multi feeding system that has two or more feeding chutes, which can increase production rates, reduce cost, and improve quality of the stone columns, and which does not have blockage problems.

The twin chute feed system has been attempted in the past but was not successful largely because if one chute became slightly blocked, air flow was reduced by the blockage at a point in time when it was necessary to have it increased in order to remove the blockage. This had a cascading effect where the flow through the blocked chute became smaller and smaller and the flow through the clear chute became correspondingly larger. Eventually one chute blocked completely. Thus, there is a need in the art for a new method & apparatus that can overcome the above problems by constantly monitoring and adjusting the flow of air and pressure of the air in: (1) stone chamber, (2) stone feed pipe (3) transition splitter chute, and (4) multiple feed chutes attached to vibratory mechanism through either a hand operated or fully automated control system.

In previous systems, if debris became stuck to the stone valve the usual way to clean the valve was to open and close it several times in the hopes that it would dislodge the debris and clear itself. As such, there is a need in the art for a new device that can overcome the above problems.

Stone capacity of the hopper is one of the factors which directly limits the stone delivery system. The size of the hopper is limited by the need to keep the equipment within legal load limits for road transportation.

The industry has chosen to limit the width of the stone skip to the same width or smaller than the stone hopper which in turn limits the width of the loader which is used to fill the skip to the same or smaller width as the skip. The industry average capacity is about 2 cycles per charge of stone. Thus, there is a need in the art for a new method & apparatus that can overcome the above problems and limitations to increase the stone storage capacity of the skip.

SUMMARY OF THE INVENTION

It is the object of the present invention to construct an apparatus to use stone columns to improve soil stability and firmness.

It is the object of the present invention to construct an apparatus that creates stone columns more economically and higher quality than has been achieved with previous equipment.

It is an object of the present invention to construct a control system that can be designed to be either hand operated or fully automated programmable controller system.

It is also the object of the present invention to construct a control system that is designed to improve the efficiency of the operation and to improve the quality of constructed stone column.

It is also the object of the present invention to construct a control system that can be designed to monitor and control for the flow of air and stone during the ground improvement process as well as simultaneously display the results on a monitor in the operator's cab in real time.

It is the object of the present invention in the preferred embodiment to construct an apparatus comprising: a crane, a skip, a hopper, a stone chamber, a stone feed pipe, a transition splitter chute, a vibratory probe mechanism, a nosecone, and a control system. Said control system whether hand operated or fully automated controller constantly monitors the flow of air and the pressure of the air in the chutes to ensure that each chute remain unblocked thus allowing a continuous and uniform discharge of material from each chute.

In the simplest version of the control system, it is comprised of: a stone valve, an air inlet valve, an air vent valve, and an air pressure sensor (Here—no air sensor, no compressor, and no air hose is needed), wherein said valves are interlocked together to pressurize the flow of material traveling from the stone chamber to feed pipe to the splitter chute to vibratory probe mechanism and then out the nosecone.

Alternatively, we could we just use a compressor and multiple air hoses (and not pressurize the system or use a stone valve, an air inlet valve, an air vent valve) to still get material to flow properly.

In another version of the control system, it is comprised of: a stone valve, an air inlet valve, an air vent valve, air pressure sensor, air flow sensor, a compressor, and at least one air hose for each chute, wherein an operator or a fully automated controller, constantly monitors and adjusts the flow of air and pressure of the air in the system to ensure for a continuous and uniform discharge of material from each chute.

It is the object of the present invention that the control system is comprised of: a stone valve, an air inlet valve, an air vent valve, air pressure sensor, a volume measuring device (e.g. air flow sensor), air modulating valves, a compressor, an air hose for each chute and an automated electronic controller that automatically adjusts air flow in the hoses and air pressure in said valves to ensure that the material continuously and uniformly travels without encountering any blockage.

It is the object of the present invention to construct an apparatus comprising: a hopper, a stone chamber, a feed pipe, a two way splitter, a vibratory probe mechanism, a nosecone, and a control system. Wherein, all of the aforementioned components (with the exception of the skip) are connected together and suspended from the main line of a crane. The skip is filled with stone using a conventional front end loader and raised to fill the hopper using the auxiliary line of the crane. A special valve (the stone valve) located between the hopper and the stone chamber is opened to allow stone to fall from the hopper into the stone chamber. The valve is closed when the hopper is empty and the stone chamber is pressurized with air. The air pressure in the stone chamber, combined with the balanced flow of flushing air which is fed through the stone chutes allows stone to be continuously and uniformly discharged from each chute. A level measuring device (interlocked with the control system) continuously monitors the rate of flow of stone leaving the stone chamber. By constantly measuring the volume of stone discharged and the depth over which the stone is discharged, it is possible to determine the diameter of the stone column constructed in the ground.

It is also the object of the present invention to construct a method of operation for this apparatus: Wherein the operator approaches the system, air pressure is at zero, all valves are open, and no stone is in the system. The hopper, stone chamber, follower tube and vibratory probe mechanism are suspended from the main winch of a crane. The skip is suspended from the auxiliary winch of the same crane. The first operation is to close the stone valve located between the hopper and the stone chamber, and fill the skip with stone using the front end loader. The auxiliary winch on the crane is used to raise the skip to full height and empty the stone from the skip into the hopper. The stone valve opens to allow stone to drop from the hopper into the stone chamber. When the hopper is emptied, the stone valve is closed and the stone chamber is pressurized. A combination of the pressure in the stone chamber, gravity, and the action of the vibratory mechanism causes the stone to travel through the stone pipe, through the transition splitter chute and out through the twin stone chutes at the tip of the vibratory probe mechanisms. Raising the vibratory probe mechanism to the predetermined height allows stone to fall into the previously created cavity. A sensor on the stone pipe measures the quantity of stone released into the cavity. Lowering the vibratory probe mechanism into the previously placed stone displaces the stone laterally into the surrounding soil. The amount of re-penetration into the previously placed soil is determined either by reaching a pre-determined diameter of stone column or by reaching a predetermined density as measured by the amount of energy applied to the vibratory probe mechanism. Depending on whether diameter or energy is controlling the process, the controlling parameter is calculated in real time and displayed on the operator's screen in the cab of the crane. The cycle of raising the vibratory probe mechanism to allow stone to discharge, and re-penetrating the stone to increase the diameter of the column is repeated until all the stone has been discharged from the stone hopper. When the sensor in the stone chamber detects that all of the stone has been discharged, the stone chamber is ventilated, the pressure is reduced to atmospheric, and the stone valve is opened. Concurrently the skip (full of stone) is raised to the stone hopper and emptied into the stone hopper. The stone valve is opened to allow stone to move from the stone hopper into the stone chamber. When the hopper has emptied all the stone into the stone chamber, the stone valve is closed, the stone chamber is pressurized. The cycle is repeated until the stone column has been constructed to the required diameter or density for the entire depth of the column.

It is a further object of the present invention to construct a method of operation for this apparatus wherein a control system monitors and controls the air pressure inside the stone chamber and the feed pipe. In addition, two separate air hoses discharge air into the stone outlet chutes close to the tip of the vibratory probe mechanism. This air flow is monitored and adjusted continuously to ensure that both chutes remain unblocked thus allowing a continuous and uniform discharge of stone from each chute. The condition of all valves (open or closed) is displayed on the operator's screen. The diameter of the stone column at each lift of stone is calculated and displayed in real time.

It is an object of the present invention to construct an apparatus that has means for opening the stone valve to allow stone to drop from the hopper into the stone chamber.

It is also an object of the present invention to construct an apparatus that has means for closing the stone valve and pressurizing the stone hopper.

It is a further object of the present invention to have an electronic control system which constantly monitors the flow of air and the pressure of the air in both stone chutes. If air flow in one chute drops below the pre-determined level, this is an indication of a potential blockage. The controller senses this change and reduces air flow to the other chute (the clear chute), and diverts more air to the potentially blocking chute which causes an increase in flow and pressure in the potentially blocking chute. As soon as the blockage is cleared the sensor detects a drop in pressure which is a signal for the controller to reverse the previous operation and balance the flow of air to both chutes. The controller constantly monitors the flow and pressure of air in both chutes and constantly makes adjustments. The monitoring and adjustment of air flow and pressure of the air in the chutes ensures that both chutes remain unblocked thus allowing a continuous and uniform discharge of stone from each chute. The electronically monitored air supply [called out as Y1 and Y2 in FIG. 11] is introduced to the system just above the transition splitter chute which connects the stone supply pipe to the vibratory probe mechanism. In addition to the air supply described above, a secondary air supply is introduced through the center of the vibratory probe mechanism. This air supply bifurcates within the vibratory probe mechanism and exits midway along the length of the vibratory probe mechanism. The air [labeled X in FIG. 11] is directed downward through the stone chutes and prevents debris from entering the stone chutes when the remainder of the system is de-pressurized. This air supply is also used when the vibratory mechanism is being lowered to the pre-determined design depth at the start of the stone column construction cycle.

It is an object of the present invention to utilize two or more air supplies in each chute to help prevent any potential blockage.

It is also an object of the present invention in alternative embodiments to utilize two or more air supplies in each chute to help prevent any debris from entering the stone chutes in an up draft when the remainder of the system is de-pressurized.

It is also an object of the present invention to pressurize air; in order to get the stone to flow [even with a single tube system] the stone chamber needs to be pressurized, and the stone chamber must be de-pressurized at the end of the cycle in order to open the stone valve and add stone to begin the next cycle. The quantity of stone added during each cycle is called a "charge of stone". The time taken to pressurize the chamber after stone has been loaded and the time needed to vent the air in preparation for the next charge of stone is non-productive time and should be kept to a minimum. The normal sequence of operation from the beginning of a cycle is as follows: the air vent valve is in the open position, the air fill valve is in the closed position, and the stone valve is in the closed position. With no pressure in the stone chamber, a charge (skip) of stone is placed in the stone hopper, the stone valve is opened, stone falls from the stone hopper into the stone chamber, the stone valve is closed, the air vent valve is closed and the air fill valve is opened. This sequence of operations causes the stone chamber to be pressurized which is necessary in order to assist the stone to travel down the stone pipe and into the two side chutes and out at the tip of the vibratory probe mechanism. It is important to know when to instigate the correct valve sequencing both from a safety and an efficiency viewpoint.

This system uses a pressure sensor mounted on top of the stone chamber and sends the information to the controller described earlier [the same controller that controls the modulated air supply to both side tubes]. In this instance the valves (air inlet valve, air vent valve, and stone valve) are interlocked together so that it is not possible to open the stone valve while the stone chamber is pressurized [could be a dangerous event]. In previous systems the decision as to when it was safe to open the stone valve was left to the operator. If the operator opened the stone valve too early while the chamber was pressurized air would rush out through the stone valve and might eject stone from the stone hopper. If the operator delayed too long in opening the stone valve it was inefficient (wasted time). With this system, if the operator wants to add stone to the stone chamber, he activates the stone valve as usual [i.e. he presses the button "Open Stone Valve"] but the stone valve will not operate until the air inlet valve has been turned off, the air vent valve has been opened and the air pressure within the system has dropped to a level where it is safe to open the stone valve. This sequence of valve changes is done automatically by the electronic controller and was all triggered by the operator indicating to the system that he wanted to fill stone (ie activate the stone valve). This is faster and safer than manual operation.

It is an object of the present invention to construct an apparatus with wear/slide plates fitted to the stone chamber outlet to assist with the stone feed.

It is a further object of the present invention to construct an apparatus that can split the quantity of stone evenly and allow the same quantity of stone to exit from both outlet chutes at the tip of the vibratory probe mechanisms.

It is an object of the present invention to construct an apparatus that has a sensor that detects the level of stone in the stone chamber, detects when all of the stone has been discharged, when the stone chamber is ventilated, when the pressure is reduced to atmospheric, and when the stone valve is opened.

It is an object of the present invention to construct an apparatus that has a control system that monitors and controls the air pressure inside the stone chamber and the stone feed pipe.

It is an object of the present invention in one embodiment to construct an apparatus that has at least one separate air hoses for discharging air into each outlet chute around the splitter to prevent blockage.

It is an object of the present invention in another embodiment to construct an apparatus that has at least one air hose positioned in each chute near the splitter and at least one air hose positioned in the middle of each chute of the vibratory probe mechanism.

It is an object of the present invention to construct an apparatus that monitors and adjusts the air flow continuously to ensure that both chutes remain unblocked thus allowing a continuous and uniform discharge of stone from each chute.

It is an object of the present invention to construct an apparatus wherein the condition of all valves (open or closed) is displayed on the operator's screen, to allow the diameter of the stone column to be calculated at each lift, and to display this information in the operator's cab in real time.

It is a further object of the present invention to construct a stone column apparatus that utilizes a twin stone feed chute which will replace the single stone tube feed system.

It is a further object of the present invention to construct an apparatus that feeds the stones to the tip of the vibratory probe mechanism using twin chutes.

It is also an object of the present invention to construct a stone column apparatus that utilizes two or more stone feed chutes.

It is an object of the present invention to construct a control system that measures and continuously monitors the flow rate of stone leaving the stone chamber.

It is also an object of the present invention to construct an apparatus that uses a control system which balances the purging air to each stone chute thus allowing each chute to flow full under all various conditions.

It is also an object of the present invention to construct an apparatus that uses an air control system that contains a device to balance air flow to each stone chute which keeps each chute flowing full under all conditions.

It is also an object of the present invention to construct an apparatus that uses a control system to continuously measure in real time the amount of stone placed into the ground which will increases the accuracy of stone column diameter calculation which will increase the quality of the final product.

It is an object of the present invention to construct a control system which constantly measuring the volume of stone discharged and the depth over which the stone is discharged, thereby allowing the user to determine the diameter of the stone column constructed in the ground over much shorter vertical intervals than could be determined with previous systems.

It is an object of the present invention to construct a faster and more efficient stone feeder than traditional systems because the twin feed chutes work without blocking.

It is also an object of the present invention to construct an apparatus with two or more chutes for feeding stone to the vibratory probe mechanism to create a more circular and concentric column than traditional systems that only feeds stone from one tube.

It is also an object of the present invention to construct an apparatus with a special tip at the nosecone where the stone is discharged which cuts the ground to allow easier penetration of the vibratory mechanism and to assist with pushing stone laterally during stone column construction.

It is also an object of the present invention to construct an apparatus that uses a nosecone which contains a device to allow faster penetration of the vibratory probe mechanism which reduces wear and tear on the external parts and further reduces potential damage to the motor of the vibratory probe mechanism.

It is a further object of the present invention in an alternative embodiment to construct an apparatus having a nosecone with air jets to assist with ground penetration.

It is an object of the present invention to construct an apparatus which allows a user to raise the vibratory probe mechanism to a predetermined height and allow stone to fall into the previously created cavity. It is also an object of this invention to utilize a sensor in the stone chamber to measure the quantity of stone released into the cavity. It is a further object of this invention to lower the vibratory probe mechanism into the previously placed stone and displace the stone laterally into the surrounding soil.

In alternative embodiments, a loader (also known as a bucket loader, front loader, front end loader, payloader, scoop loader, shovel, skip loader, and/or wheel loader) could be used instead of the skip as identified in the preferred embodiment of this invention to load material into the hopper.

It is an object of the present invention to minimize the number of times that a user has to pressurize the chamber after stone has been loaded since the time needed to pressurize the stone chamber is non-productive time. As such, there is a need in the art for a way to increase the stone capacity of the system.

It is an object of the present invention to minimize the number of times that a user has to de-pressurize the chamber after stone has been used since the time needed to vent the air in preparation for the next charge of stone is non-productive time.

It is an object of the present invention to increase the stone capacity of the system [the charge size] by double the industry average. One of the factors which has limited the capacity of previous systems as well as the industry is the need to keep the equipment within legal load limits for road transportation. In previous systems this has limited the width of the stone skip to the same width or smaller than the stone hopper which in turn limits the width of the loader which is used to fill the skip to the same or smaller width as the skip. The industry average capacity is about 2 cy per charge of stone. This system still uses a stone hopper which is within legal road transportation dimensions but the skip is over 20% wider than the hopper which means a 4 cy loader can be used to load the skip. Now, the skip is instead transported lengthwise on a truck, so it is still within legal transport dimensions. A series of baffles within the skip channel the stone from the large width of the skip to the smaller width of the road legal width of hopper. Additionally, the hopper utilizes two hooks for making a centered connection to a latch on the skip and thereby centering the larger skip about the smaller hopper and creating a pivot point for the larger skip to properly and completely dump the stone into the smaller hopper.

It is an object of the present invention to increase the stone capacity by developing a set of baffles in the skip which allows a 10 ft wide skip to discharge into an 8 ft wide hopper without spilling any appreciable amount of stone.

It is an object of the present invention to construct a skip having lifting arms that are a curved shape which causes the arm to always fall toward the back of the skip and out of the way when the loader is filling the skip with stone. This feature, along with the concealed design of the sheaves [protected by the bail arm] help protect the sheave bearings from excessive wear and/or damage.

It is an object of the present invention to construct a skip having bearings supporting the sheaves on the skip arm that are concealed to reduce the potential for accidental damage which can be caused during the dumping of stone from the loader into the skip.

It is an object of the present invention to construct a skip having two arms which are attached to an crossbar having sheaves positioned on each side for raising said skip to fill the hopper using the auxiliary line from the crane. Wherein said sheaves are positioned under the crossbar to prevent damage to the sheaves.

It is an object of the present invention to construct a skip having two curved arms which is weighted to increase the probability that the skip will always fall away from the loader.

It is an object of the present invention to construct a hopper having one or more hooks for centering the skip about the hopper allowing the skip to properly and completely dump the stone into the hopper.

It is an object of the present invention to construct a hopper having one or more hooks for connecting to a latch on the skip and thereby creating a pivot point for the skip to properly and completely dump the stone into the hopper.

It is also an object of the present invention to have a valve between the hopper and the stone chamber, which has a self-cleaning seal to ensure a complete seal without re-tries.

It is also an object of the present invention to have two picking points on each side of the center of the hopper which are directly in line with the centerline of the vibratory probe mechanism. This causes the unit to hang truly vertical which creates vertical columns and reduces stress on the apparatus.

It is also an object of the present invention to construct stone columns more economically and of better quality by increasing production rates, reducing cost, and improving quality.

It is also an object of the present invention to construct a large capacity hopper, a stone chamber, and a skip box.

It is also an object of the present invention to construct a large valve between the hopper and the stone chamber to allow faster filling.

It is also an object of the present invention to construct two large valves, an air inlet valve and an air vent valve for pressurizing and de-pressurizing the stone chamber faster that previous systems.

It is also an object of the present invention to construct the largest stone tube to allow for faster feeding of stone.

It is also an object of the present invention to provide an apparatus that is easy to manufacture, simple to assemble, reliable in operation, and relatively inexpensive to produce.

It is an object of the present invention to provide a method of using the apparatus wherein it is simple to install and use in various applications.

Instead of a skip, a loader (a bucket loader, front loader, front end loader, payloader, scoop loader, shovel, skip loader, and/or wheel loader) could be used in this invention to load the stone into the hopper.

In addition to the above objects, various other objects of this invention will be apparent from careful reading of this specification including the detailed description contained herein below.

BRIEF DESCRIPTION OF THE DRAWINGS

These as well as other features of the present invention will become more apparent upon reference to the accompanying drawings wherein like numerals designate corresponding parts in the several figures summarized as follows:

FIGS. 1-3 show a disassembled view of this apparatus, wherein:

FIG. 1 shows a side view of a feed pipe, a two way splitter, a vibratory probe mechanism, and a nosecone;

FIG. 2*a* shows an overhead view of the inside of the skip showing the baffles that are used to funnel the stones from a larger skip into a smaller hopper; and FIG. 2*b* shows a bottom perspective view of the skip;

FIG. 3 shows a front perspective view of the hopper and a stone chamber.

Other features and advantages of the invention will be become apparent from the following detailed description, taken in conjunction with the accompany drawings, which illustrate, by way of example, various features of the invention.

DETAILED DESCRIPTION OF THE PREFERRED EMBODIMENTS

The following detailed description and accompanying drawings are provided for purposes of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and the scope of the invention.

Figures 1, 2A, 2B:
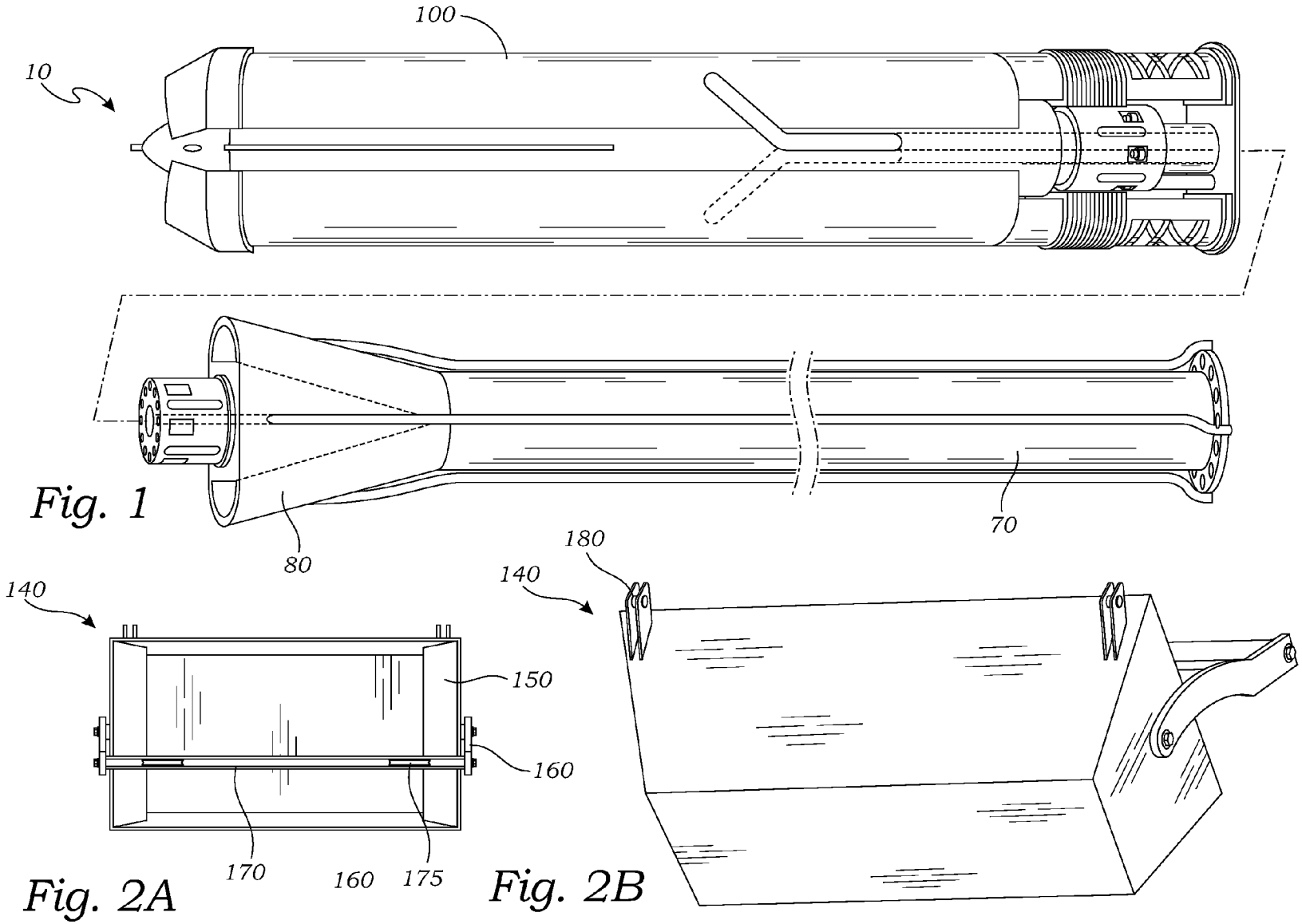
Figure 3:
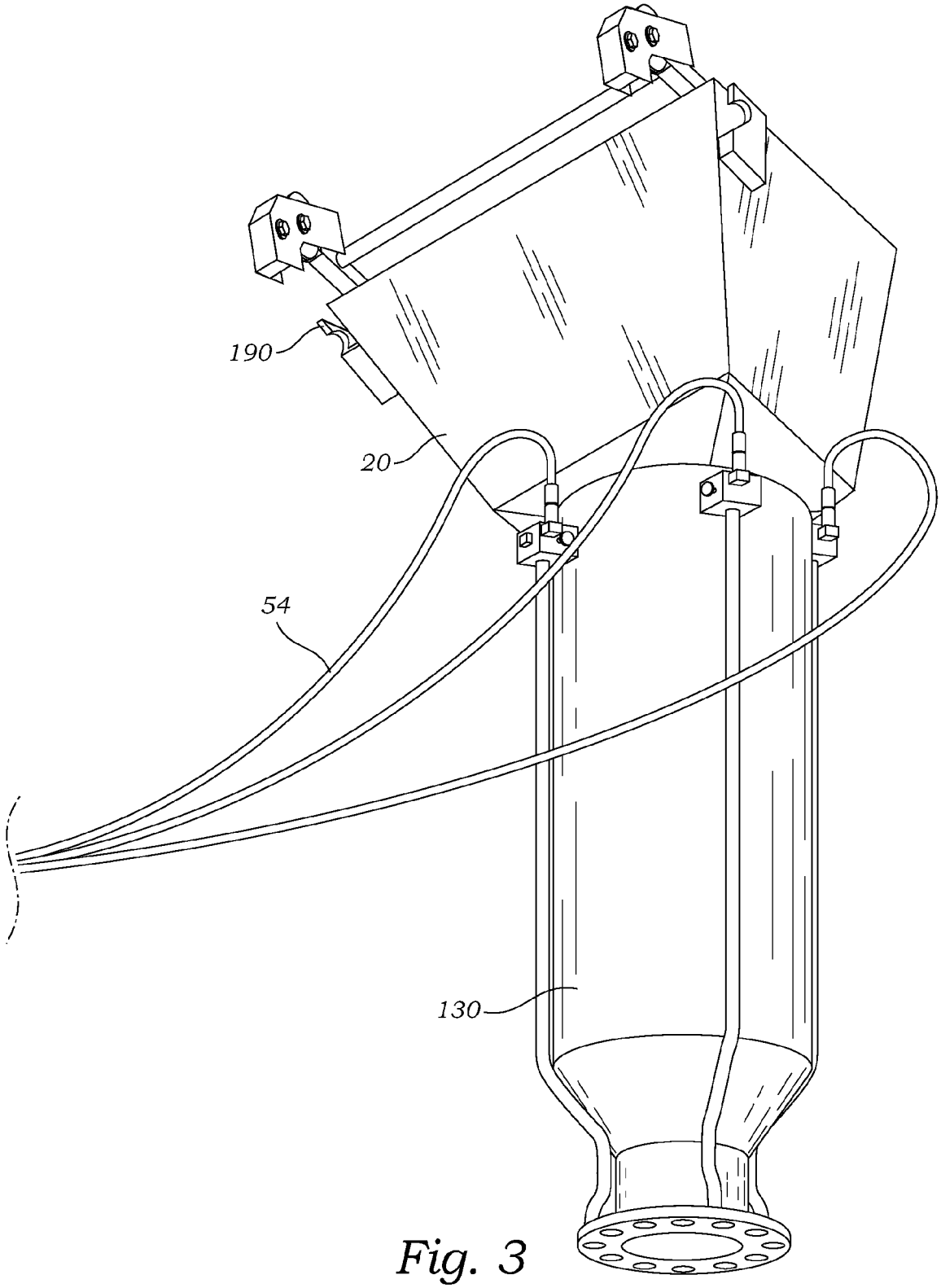
Figure 4:
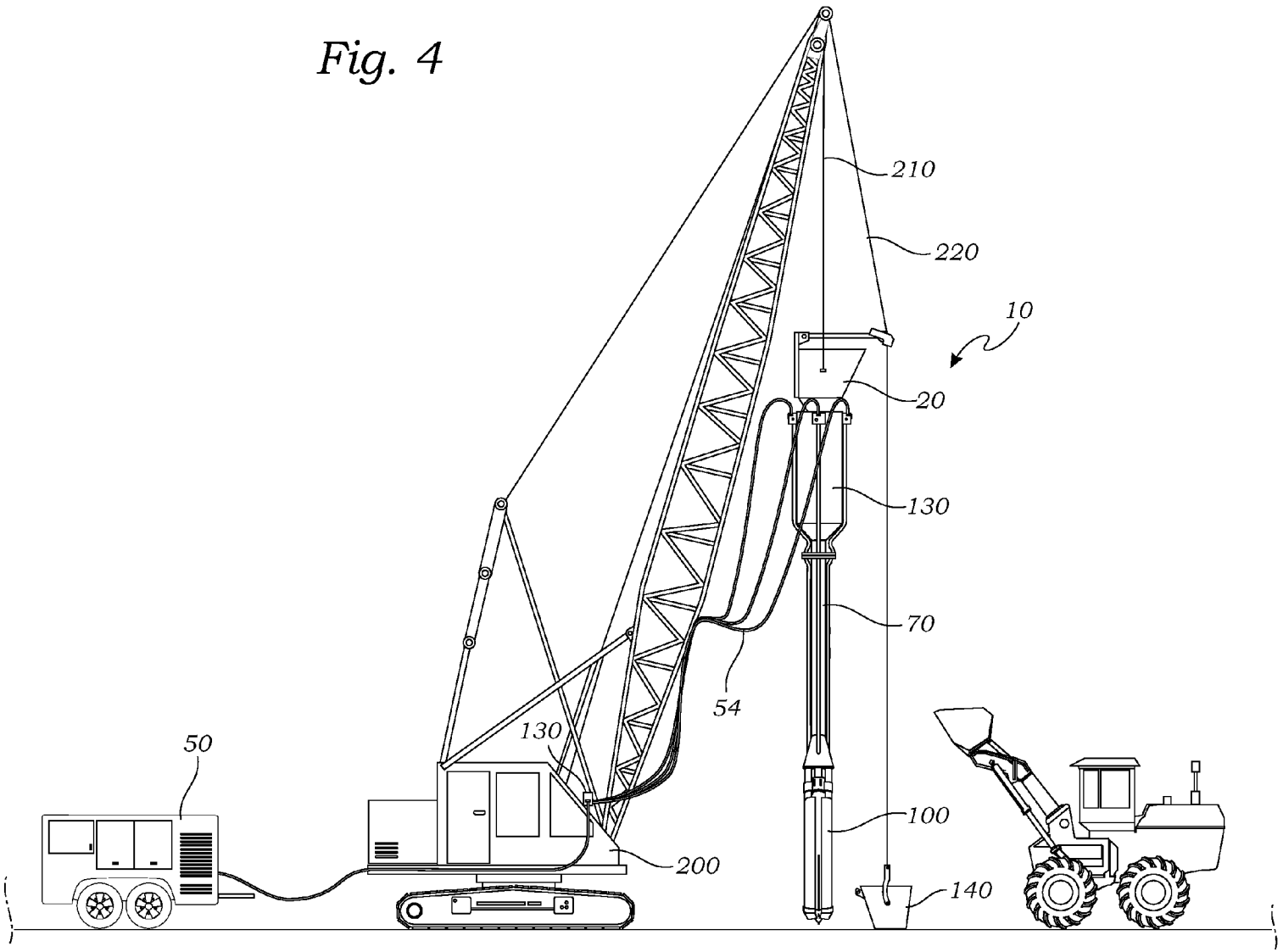
FIG. 4 is a side view of the preferred embodiment of this invention showing a skip, a hopper, a stone chamber, a feed pipe, a two way splitter, a vibratory probe mechanism, a nosecone, and a control system of this invention having air supply, all suspended from a standard crane, wherein a loader is used to load the stones into the skip or hopper.
Figure 5:
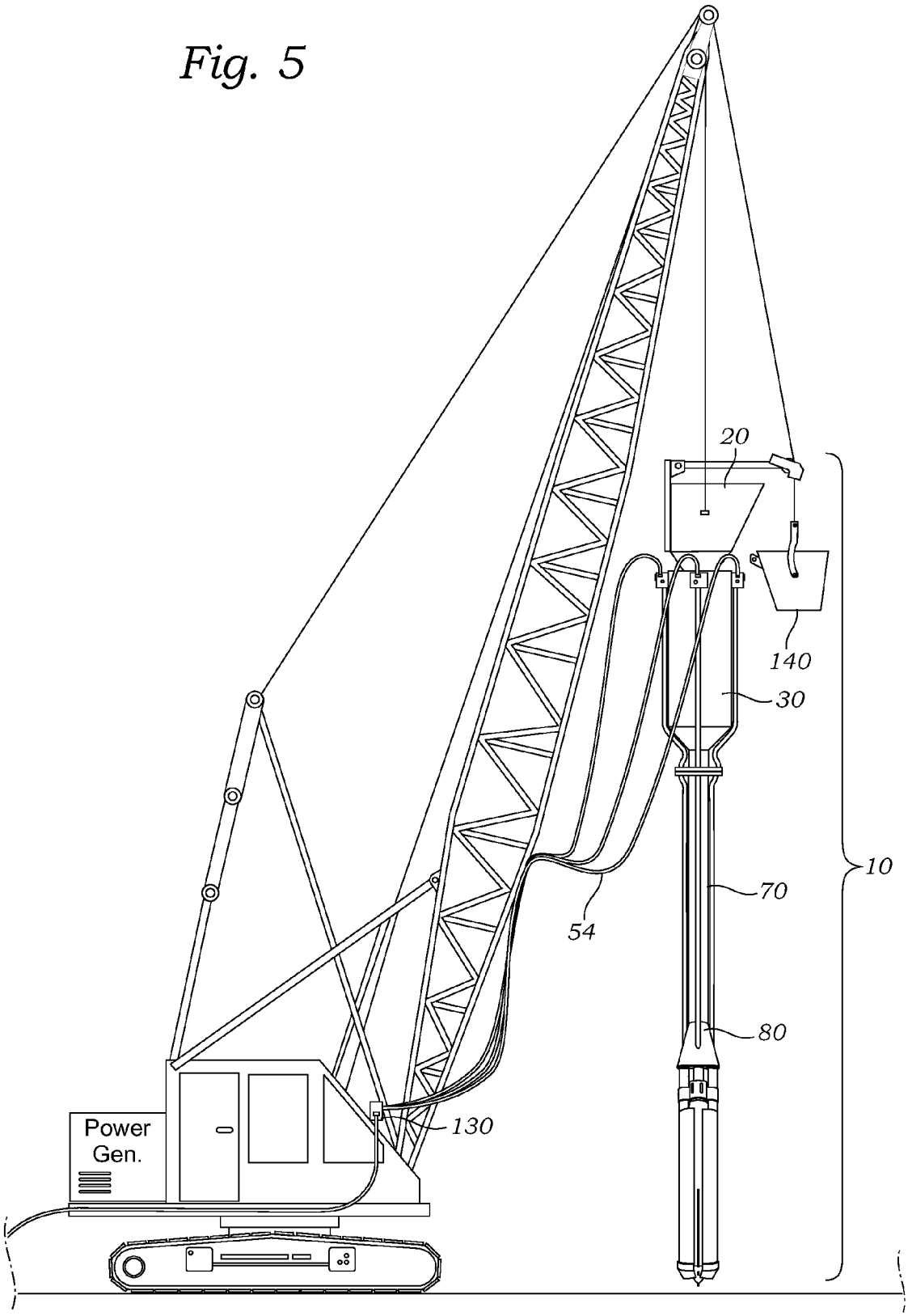
FIG. 5 is a side view of the preferred embodiment of this invention showing a skip, a hopper, a stone chamber, a feed pipe, a two way splitter, a vibratory probe mechanism, a nosecone, and a control system of this invention having air, all suspended from a standard crane.
Figure 6:
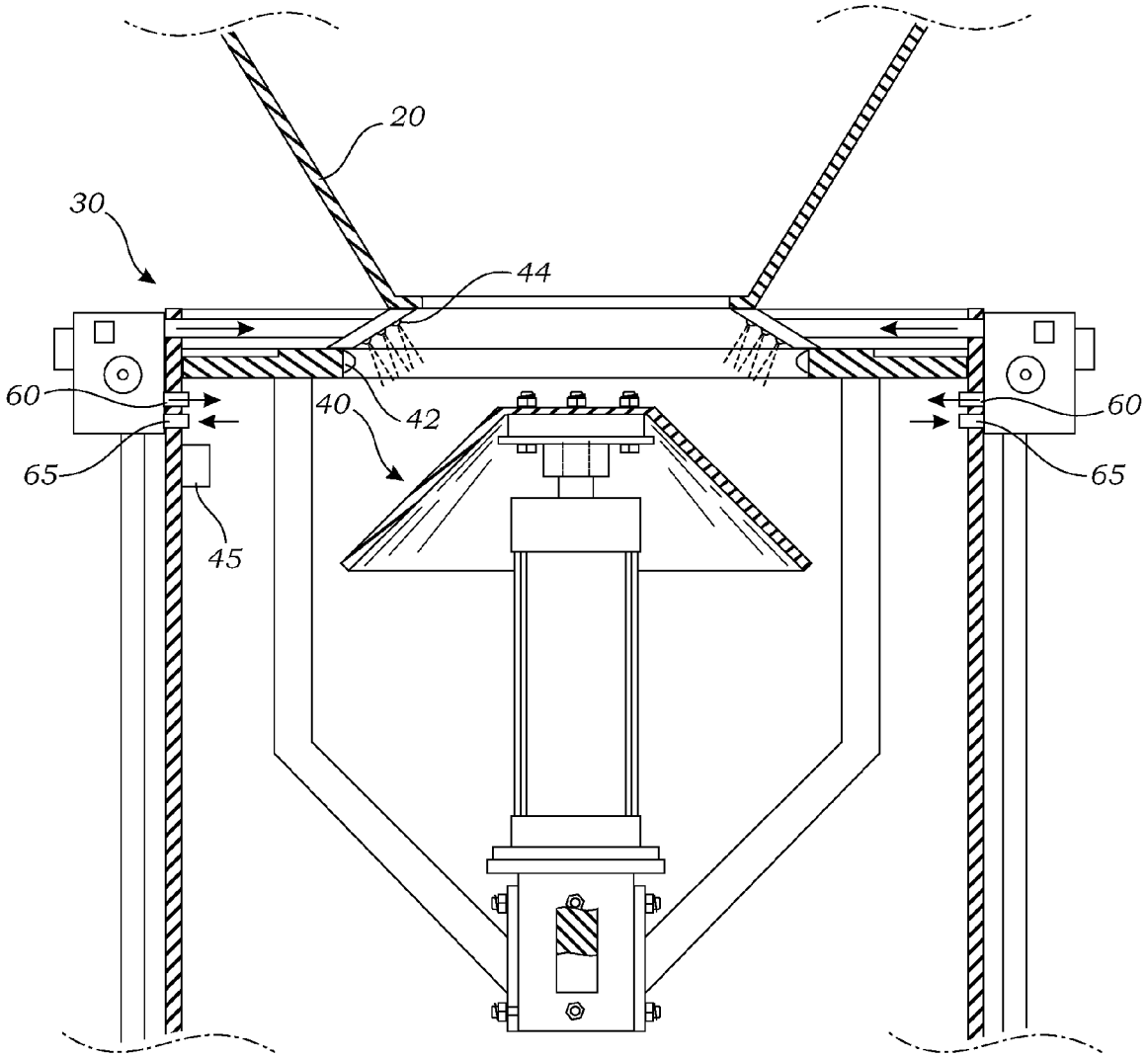
FIG. 6 is the internal structure of the stone chamber showing the stone valve located between the hopper and stone chamber, which is opened to allow the stone to fall from the hopper to the stone chamber. Also shown are a series of air jets that are located in a valve seating ring to direct air against the valve to clean said valve and remove any debris which might otherwise impact the ability of the valve to achieve an air tight seal.
Figure 7:
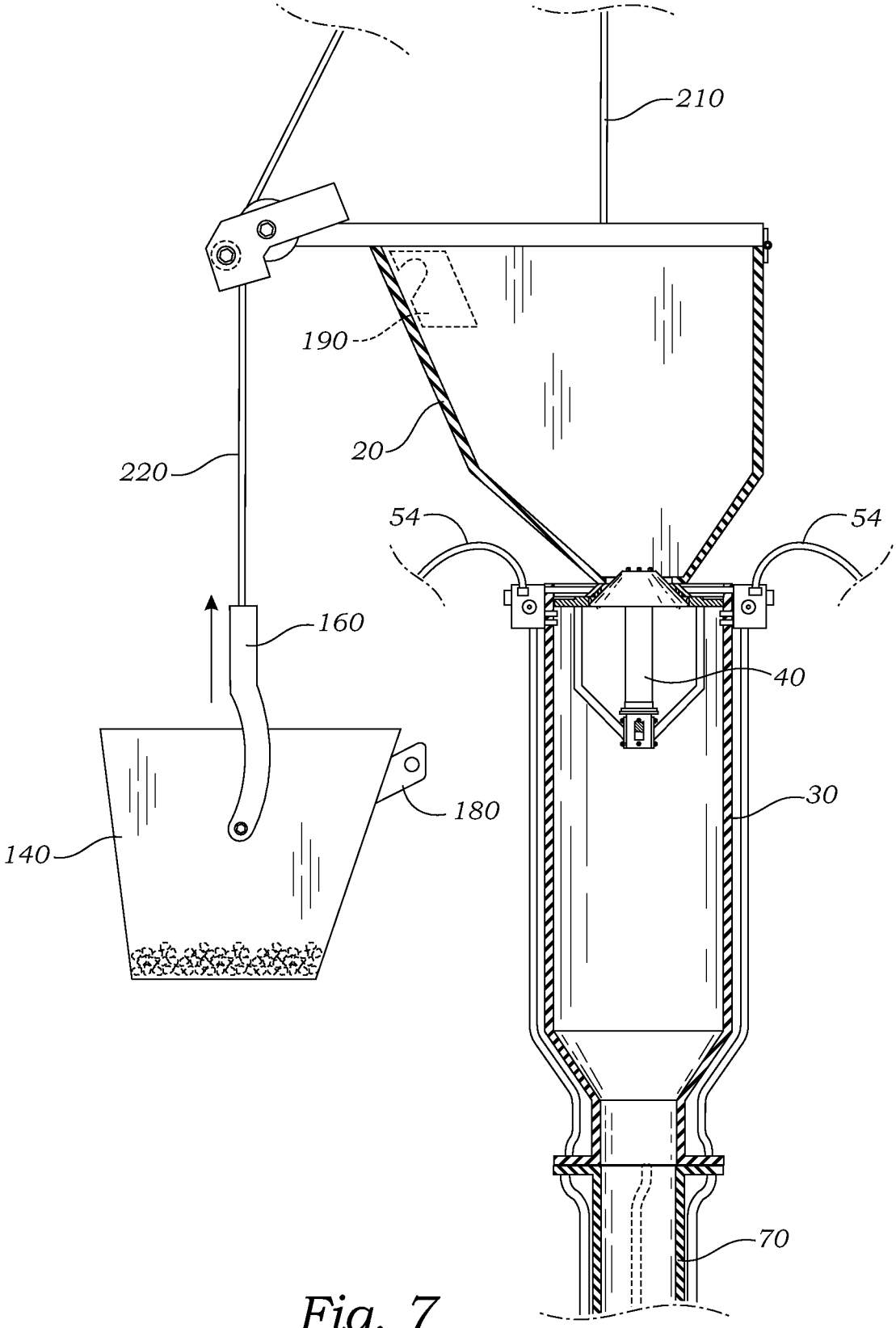
FIG. 7 is the internal structure of a skip, a hopper, stone chamber and a stone valve located between the hopper and stone chamber.
Figure 8:
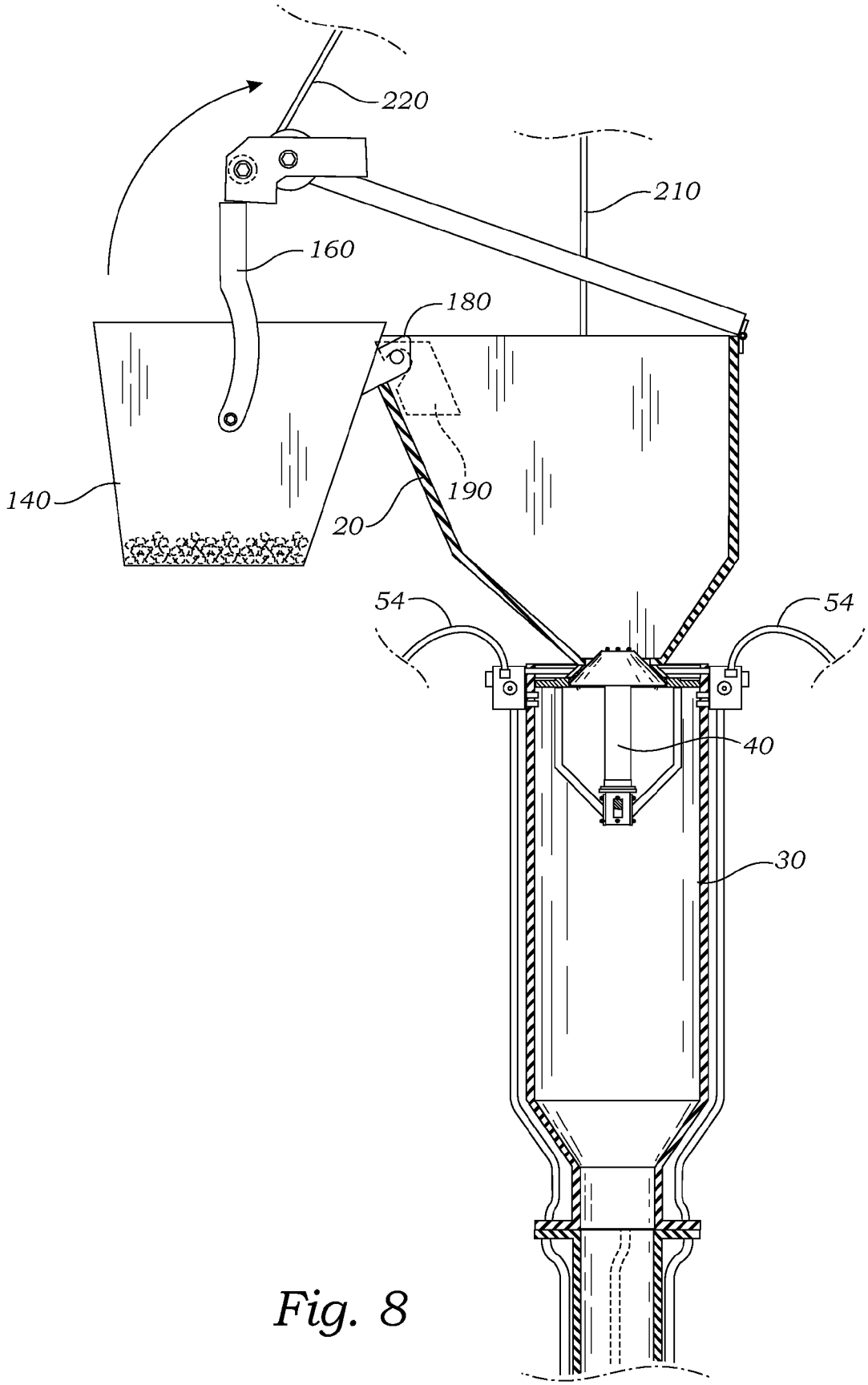
FIG. 8 is the internal structure of a skip, a hopper, stone chamber and a stone valve located between the hopper and stone chamber.
Figure 9:
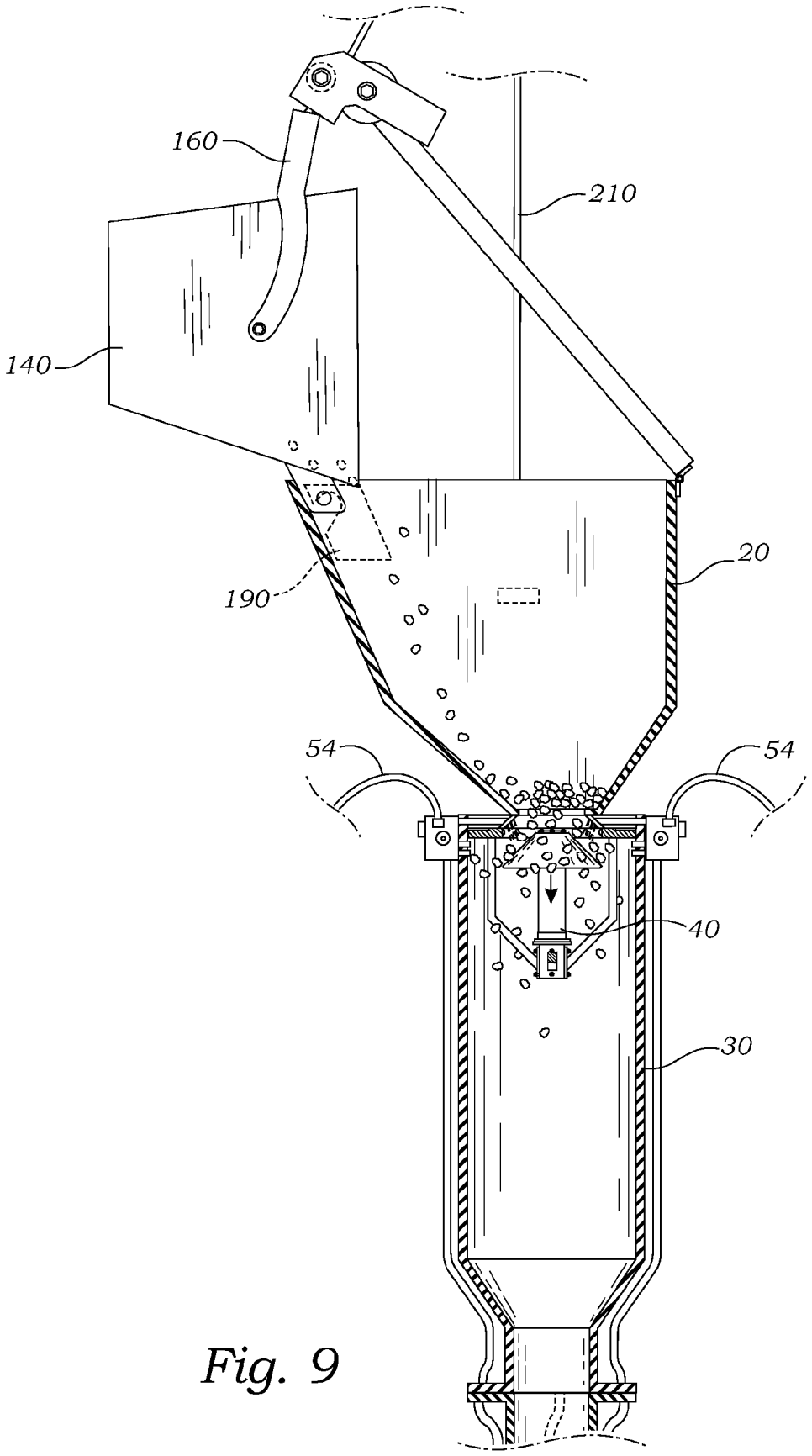
FIG. 9 is the internal structure of a skip, a hopper, stone chamber and a stone valve located between the hopper and stone chamber.
Figure 10:
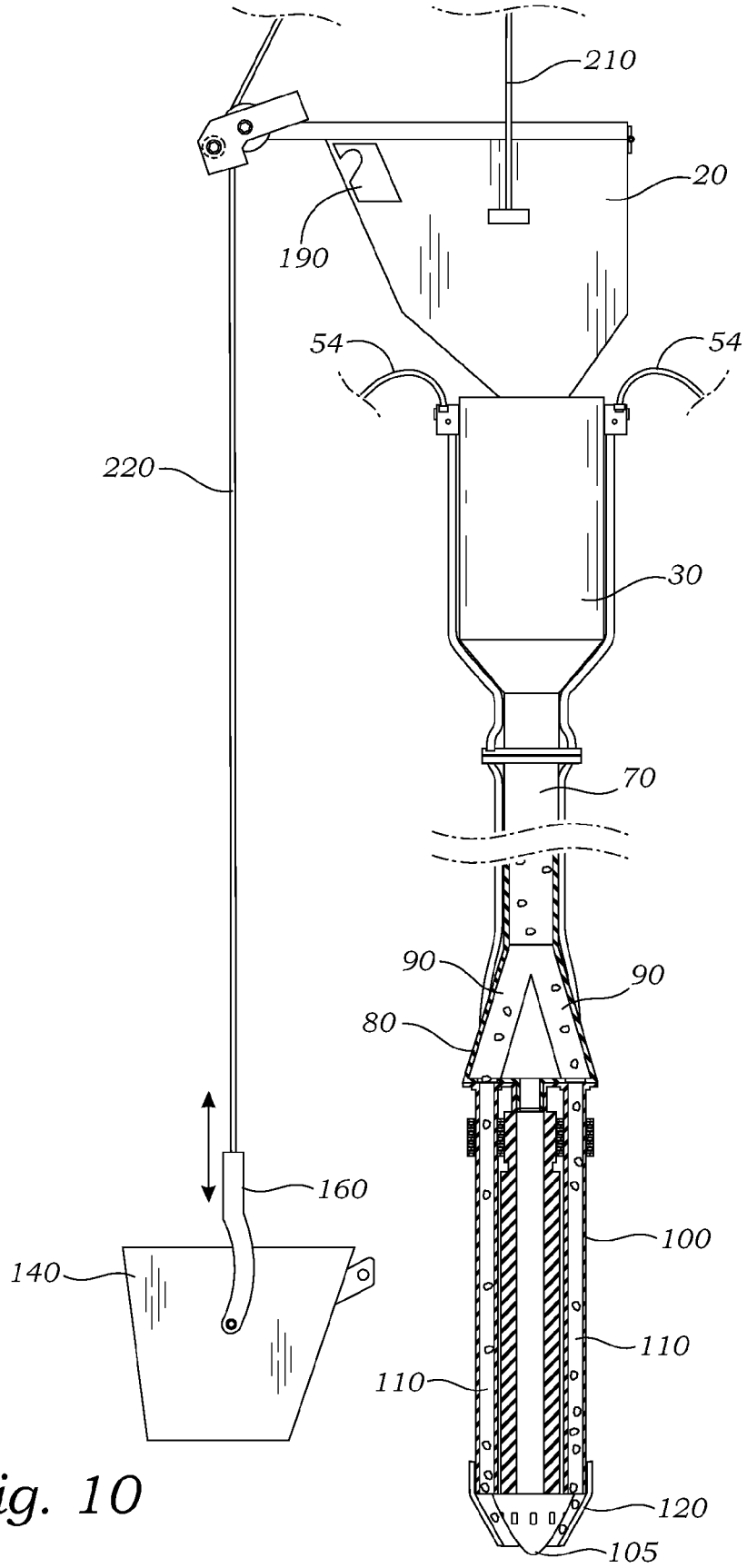
FIG. 10 shows an inside view of the inner workings of this apparatus, wherein the stone valve is closed and the system is pressurized, the pressurized stone travels from the stone chamber through the feed pipe, towards the transition splitter and ultimately down each chute of the vibratory probe mechanism and out the nosecone.
Figure 11:
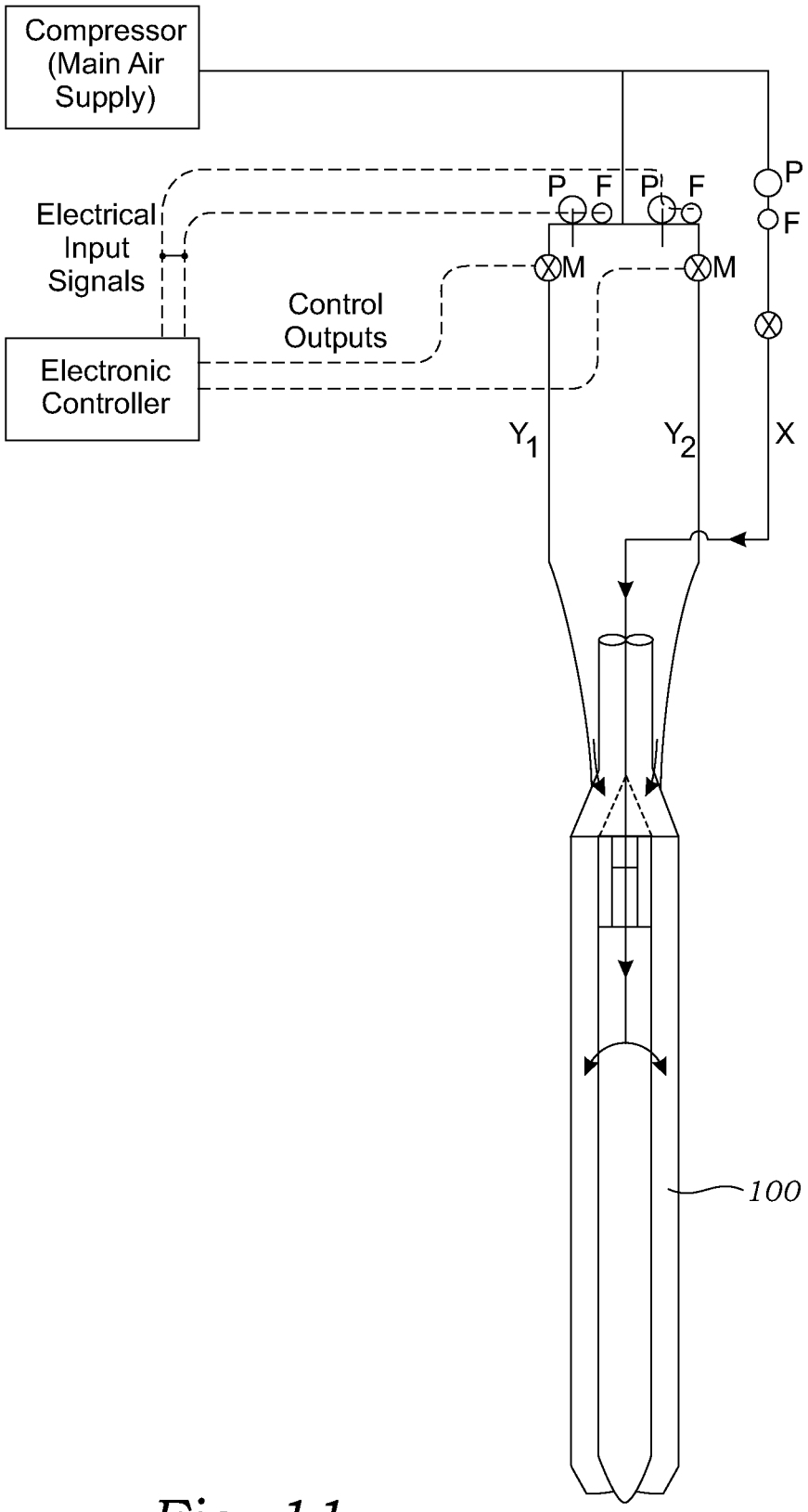
FIG. 11 shows an electronic controller and a compressor that provides the main air supply, which shows where the air is supplied to said system.

Referring to the drawings more particularly by reference numbers, FIGS. 1 through 11 shows the apparatus and method of the present invention for forming a column of compacted material in soil to increase load bearing capabilities and provide improved drainage capabilities. Thereby enhancing ground improvement namely foundation support and liquefaction mitigation.

A method of operation for this apparatus occurs wherein the operator approaches the system, air pressure is at zero, all valves are open, and no stone is in the system. The hopper 20, stone chamber 30, feeder pipe 70, splitter pipe 80 and vibratory probe mechanism 100 are suspended from the main winch 210 of a crane 200. The skip 140 is suspended from the auxiliary winch 220 of the same crane 200. The first operation is to close the stone valve 40 located between the hopper 20 and the stone chamber 30, and fill the skip 140 with stone using the front end loader. The auxiliary winch 220 on the crane 200 is used to raise the skip 140 to full height and empty the stone from the skip 140 into the hopper 20. The stone valve 40 opens to allow stone to drop from the hopper 20 into the stone chamber 30. When the hopper 20 is emptied, the stone valve 40 is closed and the stone chamber 30 is pressurized. A combination of the pressure in the stone chamber 30, gravity, and the action of the vibratory mechanism 100 causes the stone to travel through the feeder pipe 70, through the transition splitter pipe 80 and into the splitter chute 90 and out through the chutes 110 of the vibratory probe mechanisms 100. Raising the vibratory probe mechanism 100 to the predetermined height allows stone to fall into the previously created cavity. A sensor 45 on the stone chamber measures the quantity of stone released into the cavity. Lowering the vibratory probe mechanism 100 into the previously placed stone displaces the stone laterally into the surrounding soil. The amount of re-penetration into the previously placed soil is determined either by reaching a pre-determined diameter of stone column or by reaching a predetermined density as measured by the amount of energy applied to the vibratory probe mechanism 100. Depending on whether diameter or energy is controlling the process, the controlling parameter is calculated in real time and displayed on the operator's screen in the cab of the crane. The cycle of raising the vibratory probe mechanism 100 to allow stone to discharge, and re-penetrating the stone to increase the diameter of the column is repeated until all the stone has been discharged from the stone hopper 20. When the sensor 45 in the stone chamber 30 detects that all of the stone has been discharged, the stone chamber 30 is ventilated, the pressure is reduced to atmospheric, and the stone valve 40 is opened. Concurrently the skip 140 (full of stone) is raised to the hopper 20 and emptied into the hopper 20. The stone valve 40 is opened to allow stone to move from the hopper 20 into the stone chamber 30. When the hopper 20 has emptied all the stone into the stone chamber 30, the stone valve 40 is closed, the stone chamber 30 is pressurized. The cycle is repeated until the stone column has been constructed to the required diameter or density for the entire depth of the column.

It is a further method of operation for this apparatus wherein a control system 130 monitors and controls the air pressure inside the stone chamber 30 and in the system, when it is closed. In addition, two separate air hoses discharge air into the chutes. This air flow is monitored and adjusted continuously to ensure that both chutes remain unblocked thus allowing a continuous and uniform discharge of stone from each chute. The condition of all valves (open or closed) is displayed on the operator's screen. The diameter of the stone column at each lift of stone is calculated and displayed in real time.

This apparatus in one embodiment is comprised of a system 10 having: a hopper 20, a stone chamber 30, a transition splitter pipe 80 having at least two outlet chutes 90, a vibratory probe mechanism 100 having a tip 105, a nosecone 120, and a control system 130; the vibratory probe mechanism 100 has same number of chutes 110 as the transition splitter pipe 80; the additional chutes 110 are positioned along the side of the vibratory probe mechanism 100 to increasing the flow rate of a material being discharged into a soil; the hopper 20 is connected to the stone chamber 30 which in turn is connected to the transition splitter pipe 80, the transition splitter pipe 80 has chutes 90 that are connected to the chutes 110 of the vibratory probe mechanism 100, wherein the vibratory probe mechanism 100 is connected to the nosecone 120; the control system 130 constantly monitors the pressure of the air in the system to ensure that the chutes continuously and uniformly discharge the material; wherein the control system 130 has one or more valves (Stone Valve 40), and one or more sensors 45, which are interlocked together to create a pressurized air system which is necessary in order to assist the material to travel down the pipes and into the chutes and out at the tip 105 of the vibratory probe mechanism 100.

In an effort to provide soil improvement, this apparatus can use material that is selected from group consisting of sand, gravel, pebbles, stone, crushed stone, or concrete.

In another embodiment of this apparatus, a stone feed pipe 70 is used to expand stone capacity, wherein the feed pipe 70 is positioned as well as connected to the stone chamber 30 and the transition splitter chute 80.

In one embodiment of this apparatus, the control system 130 has a stone valve 40 which is located between the hopper 20 and the stone chamber 30; when the stone valve 40 is opened the material will fall from the hopper 20 into the stone chamber 30; when the stone valve 40 is closed after the hopper 20 is emptied, the stone chamber 30 is then pressurized with air; wherein the air pressure in the stone chamber 30 is combined with the air delivered by the control system used to flush the chutes (90 & 110), the material is then continuously and uniformly discharge from each chute (90 & 110).

A hanging bracket is used to position the stone valve 40 between the hopper 20 and the stone chamber 30. The apparatus that has means for opening the stone valve 40 to allow material to drop from the hopper 20 into the stone chamber 30. After the material has dropped from the hopper 20 into the stone chamber 30, the apparatus has means for closing the stone valve 40 and pressurizing the stone chamber 30.

In the preferred embodiment of this apparatus, the control system 130 further comprises an air inlet valve 60 and air vent valve 65 to more accurately control the air pressure in the system as well as control the pressurizing and de-pressurizing of the stone chamber 30 faster.

In one embodiment of this apparatus, the control system 130 further comprises a compressor 50 which is connected to said control system to supply the air to each chute (90 & 110) through an air hose 54; and wherein said control system 130 now constantly monitors the flow of air as well as the pressure of the air in said system 10 to ensure that said chutes (90 & 110) continuously and uniformly discharge said material.

It is an object of the present invention to construct a control system that can be designed to be either hand operated or fully automated programmable controller system. In one embodiment, the control system 130 has a live operator for constantly monitoring the flow of air and the pressure of the air in the chutes (90 & 110) using sensors 45 to ensure that each chute (90 & 110) remain unblocked thus allowing a continuous and uniform discharge of material from each chute (90 & 110). In another embodiment, the control system 130 has a fully automated controller, which constantly monitors the flow of air and the pressure of the air in the chutes (90 & 110) to ensure that each chute (90 & 110) remain unblocked thus allowing a continuous and uniform discharge of material from each chute (90 & 110).

Wherein the flow of air and pressure of air in the control system 130 is used to clear chutes (90 & 110) by reducing air flow from a clear chute(s) and diverts more air to the potentially blocked chute (90 & 110) which causes an increase in flow and pressure in the potentially blocked chute (90 & 110), when the blockage is cleared, the previous operation is reversed and the flow and pressure of air to each chute (90 & 110) is balanced once again.

In the preferred embodiment of this invention, the system 10 is suspended from a main line 210 of a crane 200 and a skip 140 is connected to an auxiliary line 220 of the crane 200 and the skip 140 is used to load material into the hopper 20.

In the preferred embodiment of this invention, the control system 130 has a live operator for monitoring the flow of air and pressure of air in the system and constantly makes adjustments by reducing air flow from the clear chute, and diverts more air to the potentially blocked chute air, which causes an increase in air flow and pressure in the potentially blocked chute, thereby causing the pressure sensor or the air flow sensor go off, when the blockage is cleared the operator reverses the previous operation and balances the flow and pressure of air to each chute.

In an alternative embodiment of this invention, the control system 130 has a fully automated controller, which electronically monitors the flow of air and pressure of air in the system and constantly makes adjustments by reducing air flow from the clear chute, and diverts more air to the potentially blocked chute air, which causes an increase in air flow and pressure in the potentially blocked chute, when the blockage is cleared the previous operation is reversed by the fully automated controller and the flow of air and pressure of air to each chute is balanced.

Wherein the control system 130 electronically monitors the flow of air and pressure of air in the system through the use of two or more sensors 45 to detect changes in air flow or pressure which may be an indication of a potential blockage.

In one embodiment, said stone valve 40 is located between said hopper 20 and said stone chamber 30; when said stone valve 40 is opened said material will fall from said hopper 20 into said stone chamber 30; when said stone valve 40 is closed after said hopper 20 is emptied, said stone chamber 30 is then pressurized with air; wherein the air pressure in the stone chamber 30 is combined with the balanced stone chute flushing air delivered by the control system, said material is then continuously and uniformly discharge from each chute.

In one embodiment, the control system 130 has an air inlet valve 60 and an air vent valve 65 which are used to accurately control the air pressure in the system, when the system is closed by the stone valve.

In one embodiment, the stone valve 40 has a series of air jets 44 that are located in the valve sealing ring 42 to direct air against the stone valve to clean the stone valve and remove any debris which might otherwise impact the ability of the stone valve to achieve an air tight seal.

In the preferred embodiment of this apparatus it is comprised of: a skip140; a system 10 comprised of: a hopper 20; a stone chamber 30; a transition splitter pipe 80 having at least two outlet chutes 90; a vibratory probe mechanism 100 having a tip 105; a nosecone 120; and a control system 130; said vibratory probe mechanism 100 has same number of chutes 110 as said transition splitter pipe 80; said additional chutes 110 are positioned along the side of the vibratory probe mechanism 100 to increasing the flow rate of a material being discharged into a soil; the hopper 20 is connected to the stone chamber 30 which in turn is connected to transition splitter pipe 80, the transition splitter pipe 80 has chutes 90 that are connected to the chutes 110 of the vibratory probe mechanism 100, wherein the vibratory probe mechanism 100 is connected to the nosecone 120; a compressor 50 is connected to the control system 130 to supply the air; the control system 130 has a stone valve 40, an air inlet valve 60 and an air vent valve 65, air pressure and air flow sensors 45 which are interlocked together to create a pressurized air system which is necessary in order to assist the material in traveling down the pipe and into the chutes and out at the tip of the vibratory probe mechanism; the control system 130 further comprises positioning at least one air hoses 54 directed downwardly in each chute to prevent any blockage of the material and also prevent any debris from entering the stone chutes in an up draft when the remainder of the system is de-pressurized; wherein the air inlet valve and the air vent valve are used to accurately control the air pressure in the system, when the stone valve is closed; and wherein the flow of air and pressure of air in the control system is used to clear chutes by reducing air flow from a clear chute(s) and diverts more air to the potentially blocked chute which causes an increase in flow and pressure in the potentially blocked tube, when the blockage is cleared, the previous operation is reversed and the flow and pressure of air to each chute is balanced once again.

In the preferred embodiment of this apparatus, the control system 130 has an operator for monitoring the flow of air and pressure of air in the system and constantly makes adjustments by reducing air flow from the clear chute, and diverts more air to the potentially blocked chute air, which causes an increase in air flow and pressure in the potentially blocked chute, thereby causing either the pressure sensor or the air flow sensor to go off, when the blockage is cleared the operator reverses the previous operation and balances the flow and pressure of air to each chute.

In the preferred embodiment of this apparatus, the control system 130 has a fully automated controller, which electronically monitors the flow of air and pressure of air in the system and constantly makes adjustments by reducing air flow from the clear chute, and diverts more air to the potentially blocked chute air, which causes an increase in air flow and pressure in the potentially blocked chute, when the blockage is cleared the previous operation is reversed by the fully automated controller and the flow of air and pressure of air to each chute is balanced.

In the preferred embodiment of this apparatus, a stone feed pipe 70 to expand stone capacity is used, wherein the feed pipe 70 is positioned as well as connected between the stone chamber 30 and the transition splitter chute 80.

In the preferred embodiment of this apparatus, the system 10 is suspended from a main line 210 of a crane 200 and the skip 140 is connected to an auxiliary line 220 of the crane 200; wherein a stone column construction parameters are calculated in real time and displayed on a screen in a cab of the crane for the operator to view.

Wherein the control system continuously monitors the flow rate of stone leaving the stone chamber and constantly measures the volume of stone discharged and the depth over which the stone is discharged, thereby allowing a user to determine the diameter or density of the stone column constructed in the soil in real time.

The control system that can be designed to monitor and control for the flow of air and stone during the ground improvement process as well as simultaneously display the results on a monitor in the operator's cab in real time.

In the preferred embodiment of this apparatus, said hopper 20 utilizes two hooks 190 for making a centered connection to a latch 180 on said skip 140 and thereby centering the larger skip 140 about the smaller hopper 20 and creating a pivot point for the larger skip 140 to properly and completely dump the stone into the smaller hopper 20.

In the preferred embodiment of this apparatus, said skip 140 has a series of baffles/diverter plates 150 within said skip 140 to channel said material from the large width of the skip 140 to the smaller width of hopper 20.

An object of the present invention is to have an electronic control system which constantly monitors the flow of air and the pressure of the air in both stone chutes. If air flow in one chute drops below the pre-determined level, this is an indication of a potential blockage. The controller senses this change and reduces air flow to the other chute (the clear chute), and diverts more air to the potentially blocking chute which causes an increase in flow and pressure in the potentially blocking chute. As soon as the blockage is cleared the sensor detects a drop in pressure which is a signal for the controller to reverse the previous operation and balance the flow of air to both chutes. The controller constantly monitors the flow and pressure of air in both chutes and constantly makes adjustments. The monitoring and adjustment of air flow and pressure of the air in the chutes ensures that both chutes remain unblocked thus allowing a continuous and uniform discharge of stone from each chute. The electronically monitored air supply [called out as Y1 and Y2 in FIG. 11] is introduced to the system just above the transition splitter chute which connects the stone supply pipe to the vibratory probe mechanism. In addition to the air supply described above, a secondary air supply is introduced through the center of the vibratory probe mechanism. This air supply bifurcates within the vibratory probe mechanism and exits midway along the length of the vibratory probe mechanism. The air [labeled X in FIG. 11] is directed downward through the stone chutes and prevents debris from entering the stone chutes when the remainder of the system is de-pressurized. This air supply is also used when the vibratory mechanism is being lowered to the pre-determined design depth at the start of the stone column construction cycle.

It is also an object of the present invention to pressurize air; in order to get the stone to flow [even with a single tube system] the stone chamber needs to be pressurized, and the stone chamber must be de-pressurized at the end of the cycle in order to open the stone valve and add stone to begin the next cycle. The quantity of stone added during each cycle is called a "charge of stone". The time taken to pressurize the chamber after stone has been loaded and the time needed to vent the air in preparation for the next charge of stone is non-productive time and should be kept to a minimum. The normal sequence of operation from the beginning of a cycle is as follows: the air vent valve is in the open position, the air fill valve is in the closed position, and the stone valve is in the closed position. With no pressure in the stone chamber, a charge (skip) of stone is placed in the stone hopper, the stone valve is opened, stone falls from the stone hopper into the stone chamber, the stone valve is closed, the air vent valve is closed and the air fill valve is opened. This sequence of operations causes the stone chamber to be pressurized which is necessary in order to assist the stone to travel down the stone pipe and into the two side chutes and out at the tip of the vibratory probe mechanism. It is important to know when to instigate the correct valve sequencing both from a safety and an efficiency viewpoint.

This system uses a pressure sensor mounted on top of the stone chamber and sends the information to the controller described earlier [the same controller that controls the modulated air supply to both side tubes]. In this instance the valves (air inlet valve, air vent valve, and stone valve) are interlocked together so that it is not possible to open the stone valve while the stone chamber is pressurized [could be a dangerous event]. In previous systems the decision as to when it was safe to open the stone valve was left to the operator. If the operator opened the stone valve too early while the chamber was pressurized air would rush out through the stone valve and might eject stone from the stone hopper. If the operator delayed too long in opening the stone valve it was inefficient (wasted time). With this system, if the operator wants to add stone to the stone chamber, he activates the stone valve as usual [i.e. he presses the button "Open Stone Valve"] but the stone valve will not operate until the air inlet valve has been turned off, the air vent valve has been opened and the air pressure within the system has dropped to a level where it is safe to open the stone valve. This sequence of valve changes is done automatically by the electronic controller and was all triggered by the operator indicating to the system that he wanted to fill stone (ie activate the stone valve). This is faster and safer than manual operation.

It is an object of the present invention to construct an apparatus that can split the quantity of stone evenly and allow the same quantity of stone to exit from the outlet chutes at the tip of the vibratory probe mechanisms.

A sensor to detect the level of stone in the stone chamber, detects when all of the stone has been discharged, when the stone chamber is ventilated, when the pressure is reduced to atmospheric, and when the stone valve is opened.

A control system that monitors and controls the air pressure inside the stone chamber and the stone feed pipe.

It is an object of the present invention in one embodiment to construct an apparatus that monitors and adjusts the air flow continuously to ensure that both chutes remain unblocked thus allowing a continuous and uniform discharge of stone from each chute.

It is also an object of the present invention to construct an apparatus that uses an air control system that contains a device to balance air flow to each stone chute which keeps each chute flowing full under all conditions.

The apparatus in alternative embodiments uses a control system to continuously measure in real time the amount of stone placed into the ground which will increases the accuracy of stone column diameter calculation which will increase the quality of the final product.

The control system constantly measuring the volume of stone discharged and the depth over which the stone is discharged, thereby allowing the user to determine the diameter of the stone column constructed in the ground over much shorter vertical intervals than could be determined with previous systems.

It is an object of the present invention to construct a faster and more efficient stone feeder than traditional systems because the twin feed chutes work without blocking.

It is also an object of the present invention to construct an apparatus with two or more chutes for feeding stone to the vibratory probe mechanism to create a more circular and concentric column than traditional systems that only feeds stone from one tube.

The nosecone where the stone is discharged cuts the ground to allow easier penetration of the vibratory mechanism and to assist with pushing stone laterally during stone column construction.

The nosecone allows for faster penetration of the vibratory probe mechanism which reduces wear and tear on the external parts and further reduces potential damage to the motor of the vibratory probe mechanism.

A user will typically raise the vibratory probe mechanism to a predetermined height and allow stone to fall into the previously created cavity. It is also an object of this invention to utilize a sensor in the stone chamber to measure the quantity of stone released into the cavity. It is a further object of this invention to lower the vibratory probe mechanism into the previously placed stone and displace the stone laterally into the surrounding soil.

It is an object of the present invention to minimize the number of times that a user has to pressurize the chamber after stone has been loaded since the time needed to pressurize the stone chamber is non-productive time. As such, there is a need in the art for a way to increase the stone capacity of the system.

It is an object of the present invention to increase the stone capacity of the system [the charge size] by double the industry average. One of the factors which has limited the capacity of previous systems as well as the industry is the need to keep the equipment within legal load limits for road transportation. In previous systems this has limited the width of the stone skip to the same width or smaller than the stone hopper which in turn limits the width of the loader which is used to fill the skip to the same or smaller width as the skip. The industry average capacity is about 2 cy per charge of stone. This system still uses a stone hopper which is within legal road transportation dimensions but the skip is over 20% wider than the hopper which means a 4 cy loader can be used to load the skip. Now, the skip is instead transported lengthwise on a truck, so it is still within legal transport dimensions. A series of baffles within the skip channel the stone from the large width of the skip to the smaller width of the road legal width of hopper. Additionally, the hopper utilizes two hooks for making a centered connection to a latch on the skip and thereby centering the larger skip about the smaller hopper and creating a pivot point for the larger skip to properly and completely dump the stone into the smaller hopper.

It is an object of the present invention to increase the stone capacity by developing a set of baffles/diverts in the skip which allows a 10 ft wide skip to discharge into an 8 ft wide hopper without spilling any appreciable amount of stone.

A skip having lifting arms that are a curved shape which causes the arm to always fall toward the back of the skip and out of the way when the loader is filling the skip with stone. This feature, along with the concealed design of the sheaves [protected by the bail arm] help protect the sheave bearings from excessive wear and/or damage. The skip has bearings supporting the sheaves on the skip arm that are concealed to reduce the potential for accidental damage which can be caused during the dumping of stone from the loader into the skip. The skip has two arms which are attached to an crossbar having sheaves positioned on each side for raising said skip to fill the hopper using the auxiliary line from the crane. Wherein said sheaves are positioned under the crossbar to prevent damage to the sheaves. The skip has two curved arms which is weighted to increase the probability that the skip will always fall away from the loader.

It is an object of the present invention to construct a hopper having one or more hooks for centering the skip about the hopper allowing the skip to properly and completely dump the stone into the hopper.

It is an object of the present invention to construct a hopper having one or more hooks for connecting to a latch on the skip and thereby creating a pivot point for the skip to properly and completely dump the stone into the hopper.

It is also an object of the present invention to have a valve between the hopper and the stone chamber, which has a self-cleaning seal to ensure a complete seal without re-tries.

It is also an object of the present invention to have two picking points on each side of the center of the hopper which are directly in line with the centerline of the vibratory probe mechanism. This causes the unit to hang truly vertical which creates vertical columns and reduces stress on the apparatus.

While the description above refers to particular embodiments of the present invention, it will be understood that many subsequent modifications can be made while maintaining the spirit of the subject invention intact. As such, the presently disclosed embodiments are to be considered in all respects as illustrative and not restrictive.

What is claimed is:

1. An apparatus for forming a column of compacted material in soil to increase load bearing capabilities or to provide drainage, which comprises:

a system having: a hopper, a stone chamber, a transition splitter pipe having at least two outlet chutes, a vibratory probe mechanism having a tip, a nosecone, and a control system;

said vibratory probe mechanism having same number of chutes as said transition splitter pipe;

said chutes are positioned along the side of said vibratory probe mechanism to increase the flow rate of a material being discharged into a soil;

said hopper is connected to said stone chamber which in turn is connected to said transition splitter pipe, said transition splitter pipe having said chutes that are connected to said chutes of said vibratory probe mechanism, wherein said vibratory probe mechanism is connected to said nosecone;

said control system constantly monitors the pressure of the air in said system to ensure that said chutes continuously and uniformly discharge said material;

wherein said control system has one or more valves, and one or more sensors, which are interlocked together to create a pressurized air system which is necessary in order to assist said material to travel down said pipes and into said chutes and out at the tip of the vibratory probe mechanism;

said control system being connected to a compressor and further comprises positioning at least one air hose directed downwardly in each chute; and wherein the flow of air and pressure of air in said control system is used to clear chutes by reducing air flow from a clear chute(s) and diverts more air to the potentially blocked chute which causes an increase in flow and pressure in the potentially blocked chute, when the blockage is cleared, the previous operation is reversed and the flow and pressure of air to each chute is balanced once again.

2. The apparatus in claim 1, wherein said material is selected from group consisting of sand, gravel, pebbles, stone, crushed stone, or concrete.

3. The apparatus in claim 1, wherein said system is suspended from a main line of a crane, wherein a column construction parameters are calculated in real time and displayed on a screen in a cab of said crane for an operator to view in real time.

4. The apparatus in claim 3, wherein a skip is connected to an auxiliary line of said crane and said skip is used to load said material into said hopper.

5. The apparatus in claim 3, wherein a loader is used to load material into said hopper.

6. The apparatus in claim 1, further comprising a stone feed pipe to expand stone capacity, wherein said feed pipe is positioned as well as connected to said stone chamber and said transition splitter chute.

7. The apparatus in claim 1, wherein said control system has a stone valve which is located between said hopper and said stone chamber;

when said stone valve is opened said material will fall from said hopper into said stone chamber;

when said stone valve is closed after said hopper is emptied, said stone chamber is then pressurized with air;

wherein said air pressure in said stone chamber is combined with said air delivered by said control system used to flush said outlet chutes, said material is then continuously and uniformly discharge from each chute.

8. The apparatus in claim 7, wherein said control system further comprises an air inlet valve and air vent valve to more accurately control the air pressure in said system as well as control the pressurizing and de-pressurizing of said stone chamber faster.

9. The apparatus in claim 7, wherein said control system further comprises a compressor which is connected to said control system to supply the air to each chute through an air hose; and wherein said control system now constantly monitors the flow of air as well as the pressure of the air in said system to ensure that said chutes continuously and uniformly discharge said material.

10. The apparatus in claim 9, wherein said control system has an operator for constantly monitoring the flow of air and the pressure of the air in the chutes to ensure that each chute remain unblocked thus allowing a continuous and uniform discharge of material from each chute.

11. The apparatus in claim 9, wherein said control system has a fully automated controller, which constantly monitors the flow of air and the pressure of the air in the chutes to ensure that each chute remain unblocked thus allowing a continuous and uniform discharge of material from each chute.

12. The apparatus in claim 9, wherein said control system further comprises at least one air hose directed downward in each chute(s), positioned around the splitter to prevent any blockage of said material.

13. The apparatus in claim 9, wherein said control system further comprises at least two air hose directed downward to prevent any blockage of said material.

14. The apparatus in claim 9, wherein said controller electronically monitors the air flow and pressure of air in system through the use of two or more sensors to detect changes in air flow and changes in pressure which may be indications of potential blockage.

15. The apparatus in claim 9, wherein said stone valve has a series of air jets that are located in the valve seating ring to direct air against the valve to clean said valve and remove any debris which might otherwise impact the ability of the valve to achieve an air tight seal.

16. An apparatus comprising:

a hopper; a stone chamber; a stone feed pipe; a transition splitter pipe having at least two outlet chutes; a vibratory probe mechanism having a tip; a nosecone; and a control system;

said vibratory probe mechanism having same number of chutes as said transition splitter pipe;

said chutes are positioned along the side of said vibratory probe mechanism to increase the flow rate of a material being discharged into a soil;

said hopper is connected to said stone chamber which in turn is connected to said stone feed pipe, which in turn is connected to said transition splitter pipe, said transition splitter pipe having said chutes that are connected to said chutes of said vibratory probe mechanism, wherein said vibratory probe mechanism is connected to said nosecone;

a compressor is connected to said control system to supply the air;

said control system electronically monitors the flow of air and the pressure of the air in said system to ensure that said material continuously and uniformly travels downwardly;

said control system has a stone valve, an air pressure sensor or an air flow sensor which are interlocked together to create a pressurized air system which is necessary in order to assist said material to travel down said stone pipes and into said chutes and out at the tip of the vibrator probe mechanism;

said control system further comprises positioning at least one air hose directed downwardly in each chute to prevent any blockage of said material and also prevent any debris from entering the stone chutes in an up draft when the remainder of the system is de-pressurized; and wherein the flow of air and pressure of air in said control system is used to clear chutes by reducing air flow from a clear chute(s) and diverts more air to the potentially blocked chute which causes an increase in flow and pressure in the potentially blocked chute, when the blockage is cleared, the previous operation is reversed and the flow and pressure of air to each chute is balanced once again.

17. The apparatus in claim 16, wherein said system is suspended from a main line of a crane and a skip is connected to an auxiliary line of said crane and said skip is used to load material into said hopper.

18. The apparatus in claim 16, wherein said control system has an operator for monitoring the flow of air and pressure of air in said system and constantly makes adjustments by reducing air flow from said clear chute, and diverts more air to the potentially blocked chute air, which causes an increase in air flow and pressure in the potentially blocked chute, thereby causing said pressure sensor or said air flow sensor go off, when the blockage is cleared said operator reverses the previous operation and balances the flow and pressure of air to each chute.

19. The apparatus in claim 16, wherein said control system has a fully automated controller, which electronically monitors the flow of air and pressure of air in said system and constantly makes adjustments by reducing air flow from said clear chute, and diverts more air to the potentially blocked chute air, which causes an increase in air flow and pressure in the potentially blocked chute, when the blockage is cleared the previous operation is reversed by said fully automated controller and the flow of air and pressure of air to each chute is balanced.

20. The apparatus in claim 16, wherein said controller electronically monitors the flow of air and pressure of air in said system through the use of two or more sensors to detect changes in air flow or pressure which may be an indication of a potential blockage.

21. The apparatus in claim 16, wherein said stone valve is located between said hopper and said stone chamber;

when said stone valve is opened said material will fall from said hopper into said stone chamber;

when said stone valve is closed after said hopper is emptied, said stone chamber is then pressurized with air;

wherein the air pressure in the stone chamber is combined with the balanced stone chute flushing air delivered by the control system, said material is then continuously and uniformly discharge from each chute.

22. The apparatus in claim 16, wherein said control system has an air inlet valve and an air vent valve which are used to accurately control the air pressure in said system, when said system is closed by said stone valve.

23. The apparatus in claim 16, wherein said stone valve has a series of air jets that are located in the valve seating ring to direct air against the stone valve to clean said stone valve and remove any debris which might otherwise impact the ability of the stone valve to achieve an air tight seal.

24. An apparatus comprising:

a skip;

a system comprised of: a hopper; a stone chamber; a transition splitter pipe having at least two outlet chutes; a vibratory probe mechanism having a tip;

a nosecone; and a control system;

said vibratory probe mechanism having same number of chutes as said transition splitter pipe;

said chutes are positioned along the side of said vibratory probe mechanism to increase the flow rate of a material being discharged into a soil;

said hopper is connected to said stone chamber which in turn is connected to said transition splitter pipe, said transition splitter pipe having said chutes that are connected to said chutes of said vibratory probe mechanism, wherein said vibratory probe mechanism is connected to said nosecone;

a compressor is connected to said control system to supply air;

said control system has a stone valve, an air inlet valve and an air vent valve, air pressure and air flow sensors which are interlocked together to create a pressurized air system which is necessary in order to assist said material in traveling down said pipe and into said chutes and out at the tip of the vibratory probe mechanism;

said control system further comprises positioning at least one air hose directed downwardly in each chute to prevent any blockage of said material and also prevent any debris from entering the stone chutes in an up draft when the remainder of the system is de-pressurized;

wherein said air inlet valve and said air vent valve are used to accurately control the air pressure in said system, when said stone valve is closed; and wherein the flow of air and pressure of air in said control system is used to clear chutes by reducing air flow from a clear chute(s) and diverts more air to the potentially blocked chute which causes an increase in flow and pressure in the potentially blocked chute, when the blockage is cleared, the previous operation is reversed and the flow and pressure of air to each chute is balanced once again.

25. The apparatus in claim 24, wherein said control system has an operator for monitoring the flow of air and pressure of air in said system and constantly makes adjustments by reducing air flow from said clear chute, and diverts more air to the potentially blocked chute air, which causes an increase in air flow and pressure in the potentially blocked chute, thereby causing either said pressure sensor or said air flow sensor to go off, when the blockage is cleared said operator reverses the previous operation and balances the flow and pressure of air to each chute.

26. The apparatus in claim 24, wherein said control system has a fully automated controller, which electronically monitors the flow of air and pressure of air in said system and constantly makes adjustments by reducing air flow from said clear chute, and diverts more air to the potentially blocked chute air, which causes an increase in air flow and pressure in the potentially blocked chute, when the blockage is cleared the previous operation is reversed by said fully automated controller and the flow of air and pressure of air to each chute is balanced.

27. The apparatus in claim 24, further comprising a stone feed pipe to expand stone capacity, wherein said feed pipe is positioned as well as connected between said stone chamber and said transition splitter chute.

28. The apparatus of claim 24, wherein said system is suspended from a main line of a crane and said skip is connected to an auxiliary line of said crane;

wherein a stone column construction parameters are calculated in real time and displayed on a screen in a cab of said crane for said operator to view.

29. The apparatus in claim 24, wherein said control system continuously monitors the flow rate of stone leaving the stone chamber and constantly measures the volume of stone discharged and the depth over which the stone is discharged, thereby allowing a user to determine the diameter or density of the stone column constructed in the soil in real time.

30. The apparatus in claim 24, wherein said hopper utilizes two hooks for making a centered connection to a latch on said skip and thereby centering the larger skip about the smaller hopper and creating a pivot point for the larger skip to properly and completely dump the stone into the smaller hopper.

31. The apparatus in claim 30, wherein said skip has diverter plates within said skip to channel said material from the large width of the skip to the smaller width of hopper.

32. The apparatus in claim 24, wherein said skip has a diverter plates within said skip to channel said material from the large width of the skip to the smaller width of hopper.

* * * * *